US007004300B2

(12) United States Patent
Bossler

(10) Patent No.: US 7,004,300 B2
(45) Date of Patent: Feb. 28, 2006

(54) ADJUSTABLE DISC ROLL FOR LONGITUDINALLY ORIENTING ELONGATED WOOD CHIPS

(75) Inventor: Friedrich Bossler, Weiterstadt (DE)

(73) Assignee: Maschinenfabrik J. Dieffenbacher GmbH & Co., Eppingen (DE)

( * ) Notice: Subject to any disclaimer, the term of this patent is extended or adjusted under 35 U.S.C. 154(b) by 130 days.

(21) Appl. No.: 10/615,160

(22) Filed: Jul. 7, 2003

(65) Prior Publication Data

US 2004/0003984 A1 Jan. 8, 2004

(30) Foreign Application Priority Data

Jul. 8, 2002 (DE) ..... 102 30 606

(51) Int. Cl.
*B65G 47/24* (2006.01)

(52) U.S. Cl. ..... 198/382; 198/836.1; 209/672; 144/361

(58) Field of Classification Search ..... 198/382, 198/836.1; 209/672; 144/361, 10
See application file for complete search history.

(56) References Cited

U.S. PATENT DOCUMENTS

| | | | | | |
|---|---|---|---|---|---|
| 3,677,390 | A | * | 7/1972 | Parker et al. | 198/380 |
| 4,068,991 | A | * | 1/1978 | Ufermann et al. | 425/81.1 |
| 4,295,557 | A | * | 10/1981 | Etzold et al. | 198/382 |
| 4,308,227 | A | | 12/1981 | Ufermann | |
| 4,380,285 | A | | 4/1983 | Buerkner et al. | |
| 4,469,216 | A | | 9/1984 | Haataja et al. | |
| 4,494,919 | A | * | 1/1985 | Knudson et al. | 425/83.1 |
| 4,506,778 | A | * | 3/1985 | Kilpela | 198/382 |
| 4,623,058 | A | | 11/1986 | Bossler | |
| 4,666,029 | A | | 5/1987 | Burkner | |
| 4,836,388 | A | | 6/1989 | Bielagus | |
| 4,931,243 | A | | 6/1990 | Henschel et al. | |
| 5,013,229 | A | | 5/1991 | Ufermann et al. | |
| 5,325,954 | A | * | 7/1994 | Crittenden et al. | 198/382 |
| 5,960,964 | A | * | 10/1999 | Austin et al. | 209/672 |
| 6,149,018 | A | * | 11/2000 | Austin et al. | 209/672 |
| 6,276,511 | B1 | | 8/2001 | Iredi et al. | |
| 2003/0221937 | A1 | | 12/2003 | Graf | |

FOREIGN PATENT DOCUMENTS

| | | |
|---|---|---|
| DE | 1174058 | 7/1965 |
| DE | 8006315 | 7/1981 |
| DE | 3731322 | 3/1988 |
| DE | 19544866 | 6/1997 |

(Continued)

*Primary Examiner*—Gene O. Crawford
*Assistant Examiner*—Rashmi Sharma
(74) *Attorney, Agent, or Firm*—W. F. Fasse; W. G. Fasse

(57) ABSTRACT

An apparatus for longitudinally orienting pre-glued elongated wood strands for forming OSB panels includes a spreading head with disc rolls that each have discs arranged parallel to one another on a rotatable shaft arranged over a forming belt. The discs of a given disc roll intermesh overlappingly in the interspaces between the discs of the adjacent disc rolls, to form vertical orienting passages between the intermeshing discs. The shaft or the individual discs of at least one of the disc rolls is/are slidably adjustable in the axial direction of the shaft, to adjust the axial width of the orienting passages. In a method of operating the apparatus, the width of the orienting passages is adjusted depending on the dimensions, the dimensional variation or tolerance, and/or the throughput quantity of the supplied strand material. Thereby, the throughput quantity and the longitudinal orienting of the strands can be optimized, depending on the particular strand material.

19 Claims, 2 Drawing Sheets

FOREIGN PATENT DOCUMENTS

| | | |
|---|---|---|
| DE | 29707143 | 8/1997 |
| EP | 0175015 | 3/1986 |
| EP | 0292581 | 11/1988 |
| EP | 0727293 | 8/1996 |
| WO | WO/9604115 | 2/1996 |
| WO | WO01/66324 | 9/2001 |

* cited by examiner

ADJUSTABLE DISC ROLL FOR LONGITUDINALLY ORIENTING ELONGATED WOOD CHIPS

PRIORITY CLAIM

This application is based on and claims the priority under 35 U.S.C. §119 of German Patent Application 102 30 606.0, filed on Jul. 8, 2002, the entire disclosure of which is incorporated herein by reference.

FIELD OF THE INVENTION

The invention relates to an apparatus including a disc roll for longitudinally orienting elongated wood chips or particularly wood strands, especially for producing oriented strand/structural board (OSB) or other panels with oriented chips or strands. The invention further relates to a method of using such an apparatus.

BACKGROUND INFORMATION

Panels or sheets comprising oriented material chips, and especially panels made of oriented elongated wood strands, known as oriented strand board or oriented structural board (OSB) panels in the art, represent structural chip board panels having higher strength characteristics than chip board panels or sheets without purposely oriented chips. The chips or elongated strands that are used for forming such OSB sheets or panels in the ideal case have a length-to-width ratio or strand aspect ratio of about 10:1. Furthermore, such panels typically have a multi-layered construction.

Mechanical chip spreading machines are conventionally used for forming such multi-layered panels. The spreading machines furthermore include spreading heads that may include an apparatus for orienting the flat elongated wood strands, so as to deposit or spread the wood strands in a desired orientation for each respective layer forming the panel on a forming belt. This orienting of the strands is generally carried out by mechanically orienting the strands in one or more orienting chutes, shafts or passages, and then depositing the oriented strands onto the forming belt. In this context, improving the quality or precision of the orienting of the strands can achieve an increased bending strength of the resulting finished panel. Nonetheless, it has become more difficult to achieve a precise and uniform orienting of the strands, and especially the orienting of the strands in the longitudinal direction on the outer surface or cover layers of the panel. This is because the strand board production plants have been developed to ever greater production capacities, and because the typically utilized strands being produced are becoming longer, e.g. typically 100 to 150 mm long at the present time, and these strands exhibit greater variations or fluctuations in their strand width. These factors all make it more difficult to orient the strands uniformly, consistently, and accurately in the intended orientation.

The German Patent Laying-out Publication DE-AS 1,174,058 discloses a spreading head having disc rolls for orienting wood chips. Respective orienting passages or vertical shafts are formed respectively between adjacent discs. This is achieved in that the respective discs of the neighboring rotational shafts intermesh or engage centrally with each other while forming lateral through-flow interspaces or passages therebetween. In other words, the discs of one disc roll are located respectively in the centers of the axial spaces between the discs of the adjacent disc roll. According to the reference, the resulting through-flow interspaces or passages have a width that is slightly larger than the average length of the wood chips that are to be oriented and spread. As a result of the limited partial overlapping of the discs, large non-overlapping areas are formed between the discs of one disc roll shaft with through-flow spacings that are essentially twice as large as the average chip length, so that the chips are only inadequately oriented in these rather large areas.

Published European Patent Application EP 0,175,015 discloses a method and an apparatus for longitudinally orienting chips for the production of OSB panels. The apparatus includes a spreading head with disc rolls, whereby the discs of the adjacent disc rolls intermesh with each other in an overlapping manner, but only form through-flow spaces or passages on one side of a respective disc in a particular embodiment. Namely, the width of a respective through-flow passage is maximized to almost the spacing width between successive discs axially along a single disc roll by having the respective adjacent discs of adjacent disc rolls almost touching each other in the axial direction. That arrangement aims to achieve orienting or guide passages having the required confined orienting width over larger areas, i.e. with lengthened vertical guide surfaces. Thereby, the abovementioned non-overlapping double-width areas of the passages are avoided, and the desired orienting of the strands is ensured over a longer vertical distance or path.

However, with such an apparatus, a relatively accurate or exact longitudinal orienting of the strands is only achievable when operating with a particular determined through-flow or output quantity. Namely, the width and length of the respective orienting through-flow passages must be particularly adapted or designed for the through-flow rate or quantity that is to be processed by the apparatus. In the event varying or deviating through-flow rates arise in operation, the quality of the achieved longitudinal orientation will be impaired. Namely, with small through-flow rates, the proportion of smaller strands can fall at least partially un-oriented through the too-large through-flow passages. On the other hand, for large through-flow rates, an undesired separating effect of the different strand sizes can arise. Thus, it has been found that a uniform and consistent panel quality cannot be achieved when using such a conventional apparatus in connection with varying chip material through-flow rates.

SUMMARY OF THE INVENTION

In view of the above, it is an object of the invention to provide a method and an apparatus for longitudinally orienting flat elongated wood chips or strands, with which oriented strand panels having a uniform and consistent quality and particularly a uniform and consistent orientation of the strands can be produced, even while processing different or varying strand material through-flow rates. Another object of the invention is to make the method and apparatus adaptable to different operating requirements such as different strand material through-flow rates. The invention further aims to avoid or overcome the disadvantages of the prior art, and to achieve additional advantages, as apparent from the present specification.

The above objects have been achieved according to the invention in an apparatus for longitudinally orienting elongated chips or strands of a spreadable bulk material, and especially pre-glued, flat, elongated wood strands for producing structural panels of oriented strands. The apparatus includes vertically arranged orienting elements which cooperate to define orienting shafts or passages therebetween. Especially according to the invention, at least some of the orienting elements are movable and adjustable relative to other ones of the orienting elements so that the orienting passages have an adjustable width perpendicular to the strand conveying direction. Preferably, the orienting elements are embodied as discs arranged parallel to one another and spaced apart along a rotational shaft to form a respective disc roll, whereby the discs of neighboring or adjacent disc rolls overlappingly intermesh with one another to form the orienting passages therebetween. Namely, a respective orienting passage is bounded or formed between two axially adjacent or neighboring discs respectively of two neighboring disc rolls, whereby the axial spacing between these discs defines the relevant width of the orienting passage, and at least one of these discs is axially adjustable relative to the other for adjusting the width of the resulting orienting passage. Throughout this specification, the term "axial" refers to the direction parallel to the axis of each disc roll.

The above objects have further been achieved according to the invention in a method of using or operating such an apparatus, including steps of supplying a bulk material flow of strands onto a plurality of vertically arranged orienting elements which form respective orienting passages by cooperation with each other, rotating or oscillating the orienting elements, and thereby causing the strands to fall or flow through the orienting passages while being oriented longitudinally relative to the material conveying direction onto a forming belt. Especially further according to the invention, the width of the orienting passages is adjusted depending on the geometric dimensions of the supplied chips or strands, the strand tolerances, and/or the flow quantity or rate of strands to be oriented and spread.

Due to the adjustability of the width of the orienting passages, the invention advantageously can achieve a uniform, consistent and exact longitudinal orienting of all different sizes of wood chips or strands in a continuously spreadable material fleece or mat, even for varying material throughput quantities or rates. Thus, even with sharply varying or differing dimensions of the wood chips, it is still possible to provide proper adjusted orienting passage widths that will constantly and reliably orient all chip sizes in the desired longitudinal orientation. Furthermore, the orienting passage widths of different ones of the disc rolls can be adjusted in such a manner so that longer wood strands will be deposited on the outer cover layers of the resulting panel while shorter wood strands will be deposited in the middle or core of the resulting panel, whereby panels having an especially high bending strength or stiffness can be manufactured.

BRIEF DESCRIPTION OF THE DRAWINGS

In order that the invention may be clearly understood, it will now be described in connection with example embodiments, with reference to the accompanying drawings, wherein.

DETAILED DESCRIPTION OF A PREFERRED EXAMPLE EMBODIMENT AND OF THE BEST MODE OF THE INVENTION

Figure 1:
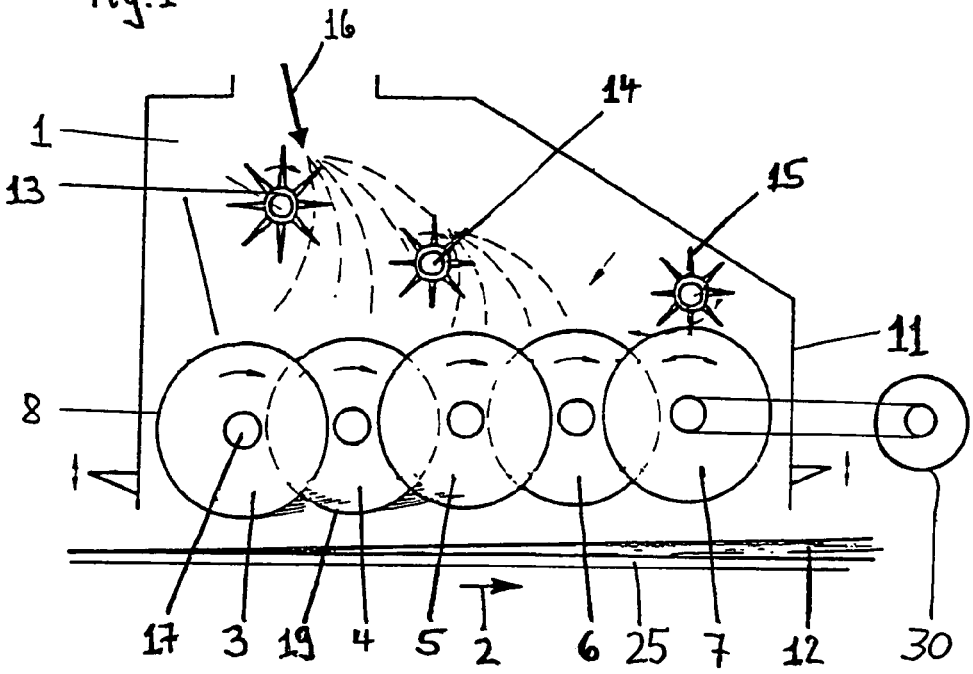
FIG. 1 is a schematic side view of an apparatus according to the invention, comprising a cover layer spreading head with axially adjustable disc rolls.

FIG. 1 generally illustrates an apparatus according to the invention comprising a cover layer spreading head 1, for dispersing or spreading wood strands for manufacturing oriented strand board (OSB) panels. The wood strands have previously been coated or mixed with a glue and are then supplied into the spreading head 1 as a bulk material or strand flow 16 from a dosing hopper or the like (not shown). The spreading head 1 is equipped with five disc rolls 3, 4, 5, 6, 7 that are arranged one after another in the conveying direction 2 of the forming belt 25 arranged below the disc rolls. In the present embodiment, three of the disc rolls 3, 5 and 7 are fixed with respect to their axial position, while two of the disc rolls 4, 6 are axially adjustable as will be described in further detail below. By axially adjusting these two disc rolls 4 and 6, or at least the discs arranged thereon, the width W of the orienting passages 9 and 10 formed between the discs 8 and 19 of respective adjacent ones of the disc rolls can be adjusted.

In greater detail, the cover layer spreading head 1 further comprises a height adjustable housing 11, which may be adjusted in height to achieve a prescribed spacing distance above the forming belt 25 parallel to the dispersion angle or angle of repose of the strand fleece or mat 12 formed of the dispersed wood strands. The spreading head 1 further comprises two pre-loosening or pre-dispersing rolls 13 and 14 as well as a throw-back or reverse raking roll 15 in addition to the above mentioned five disc rolls 3, 4, 5, 6 and 7. Each of these rolls is arranged and supported in the housing 11 in a rotatable manner, i.e. by suitable rotation bearings. Furthermore, the pre-dispersing rolls 13, 14, the reverse raking roll 15, and at least some, or preferably all of the disc rolls 3, 4, 5, 6 and 7 are rotationally driven by any conventionally known rotational drive means, such as an electric motor, connected to the rolls through any known drive transmission arrangement such as a gear train, a chain drive arrangement, a belt drive arrangement, etc., which is indicated merely schematically and generically by the drive 30 coupled to the disc roll 7.

The original non-oriented bulk strand material flow 16 consists of flat elongated wood strands that are typically about 100 to 150 mm long, about 25 to 45 mm wide, and about 0.5 mm thick, and that have been previously coated or intermingled with a suitable glue. The glued wood strands are supplied from a dosing hopper or the like (not shown), first onto the pre-dispersing rolls 13 and 14, which then distribute the strand flow 16 onto the disc rolls 3, 4, 5, 6 and 7. The disc rolls 3, 4, 5, 6 and 7 are arranged one after another in the conveying direction 2 of the forming belt 25, and are rotationally driven at a constant rotational speed in the clockwise direction as shown in the present example embodiment. The reverse raking roll 15 is provided when needed, and is also driven in the clockwise rotational direction, so as to rake or comb back any excess amount of the wood strands that has traveled all the way to the last disc roll 7. Thereby, the reverse raking or casting roll 15 throws such excess chips or strands back into the material flow to be processed and oriented through the disc rolls.

Each one of the disc rolls 3, 4, 5, 6 and 7 comprises a respective rotational shaft 17 that is rotationally supported and driven in the housing 11, as well as a prescribed number of vertically oriented discs 8 that are arranged spaced apart from one another along the axial direction 18 of the respective rotational shaft 17. In the preferred embodiment, all of the discs 8 are arranged with a uniform spacing distance between adjacent ones of the discs, for example preferably 50 mm, which preferably corresponds to approximately one third of the average length of the wood strands that are to be processed. This achieves a good longitudinal orienting of the strands. Also in this example embodiment, the discs 8 all have the same outer diameter, of preferably 340 mm. In a preferred embodiment, one or two discs having a somewhat smaller diameter are arranged successively at a regular spacing after the outermost discs 8 of the arrangement described above. With such additional smaller diameter discs, the flat elongated wood strands that have fallen transversely onto the disc rolls 3, 4, 5, 6, 7, i.e. oriented substantially along the axial direction 18, will be more easily introduced into the interspaces or orienting passages formed between the successive discs 8.

Figure 2:
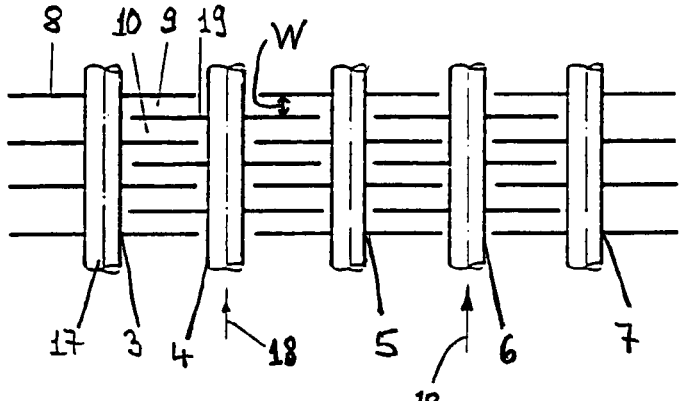
FIG. 2 is a schematic top plan view onto the disc rolls of the apparatus of FIG. 1, wherein the disc rolls have been adjusted to a middle or average orienting passage width adjustment.
Figure 3:
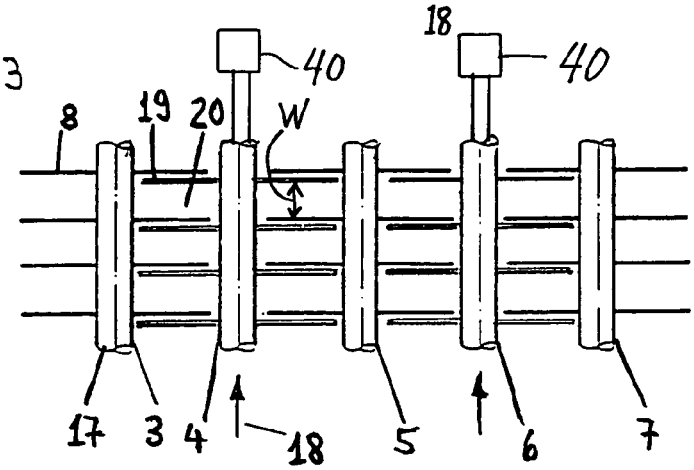
FIG. 3 is a schematic top plan view similar to that of FIG. 2, but showing a condition in which the disc rolls have been adjusted to the largest possible orienting passage width adjustment.
Figure 4:
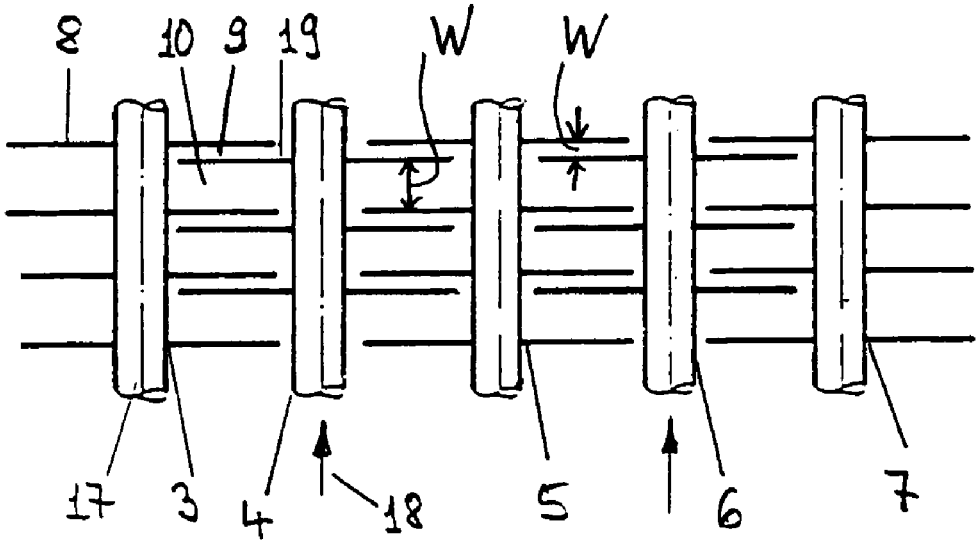
FIG. 4 is a schematic top plan view similar to that of FIGS. 2 and 3, but showing a condition in which the disc rolls have been adjusted to an intermediate orienting passage width adjustment.

The adjustable and thus variable arrangement of the discs 8 and/or 19 (and particularly 19 in this embodiment), and the corresponding formation of the adjustable orienting passages 9, 10 therebetween, are shown in a top plan view in FIGS. 2, 3 and 4. In the illustrated embodiment, the respective shafts 17 of the second disc roll 4 and of the fourth disc roll 6 are each slidably or movably arranged so as to be adjustable in an axial direction 18 from a prescribed central or middle position. On the other hand, the first disc roll 3, the third disc roll 5, and the fifth disc roll 7 in the conveying direction 2 are arranged at a fixed axial position, i.e. without being adjustable in the axial direction 18.

In this regard, FIG. 2 shows an initial position in which the adjustable disc rolls 4 and 6 are adjusted relative to the non-adjustable disc rolls 3, 5 and 7 so that the discs 19 of the adjustable disc rolls are respectively positioned in the middle of the interspace between successive ones of the discs 8 of the non-adjustable disc rolls 3, 5 and 7. In other words, the overall arrangement of FIG. 2 has the discs 8 and 19 of respective adjacent disc rolls intermeshing with one another in an overlapping manner, whereby the discs of one disc roll are positioned centrally between (in the axial direction 18) the discs of the neighboring disc roll. As a result, each respective pair of discs 8 and 19 of the adjacent disc rolls form a respective vertical orienting shaft or passage 9, 10 therebetween, through which the elongated wood strands can flow or fall downwardly onto the forming belt 25 located therebelow, while the strands are oriented longitudinally in a lengthwise direction or e.g. in the conveying direction 2 of the forming belt 25. Namely, the rotationally driven discs 8 and 19 form orienting elements, while the passage respectively bounded therebetween forms orienting shafts or passages 9 and 10.

In FIG. 2, since the discs 8 and 19 of the respective adjacent or neighboring disc rolls are adjusted so as to positioned centrally in the interspace axially between the successive discs of the neighboring disc roll, this respectively forms two orienting passages 9 and 10 on opposite sides of each disc 19 of each adjustable disc roll 4, 6. Due to the centered position of the adjustable disc rolls, the orienting passages 9 and 10 thereby all have the same width W in the axial direction 18, which width W is somewhat smaller than half of the disc spacing on the given one of the disc rolls. For example, if each disc 8, 19 is 5 mm thick, and the discs are spaced 50 mm apart on a given individual disc roll, then the resulting orienting passage width of each orienting passage 9, 10 is about 22.5 mm.

This initial or basic position is achieved by arranging or adjusting the bearing positions of the two shaft bearings of the adjustable second disc roll 4 and fourth disc roll 6 by an amount of half of the disc spacing in the axial direction 18 in comparison to the non-adjustable disc rolls 3, 5, and 7. With this arrangement, all of the resulting orienting passages 9, 10 have the same width. This arrangement, however, suffers difficulties when the chip or strand material to be oriented and spread has a relatively high proportion of long and wide strands, because such long and wide strands have a tendency to bounce, churn, or dance on the upper edges of the discs 8, 19 for a relatively long time before they are aligned properly to be able to fall down through the relatively narrow orienting passages 9, 10 in a longitudinally oriented fashion so as to be deposited in this oriented fashion onto the forming belt 25. As a result, it has been found in practice, that only a relatively small bulk material quantity per unit time can be processed, i.e. oriented, spread and deposited, using such a spreading head with such a position of the disc rolls, when the bulk material to be spread includes a high proportion of wider and longer strands. Moreover, if one would attempt to increase the throughput rate by increasing the disc spacings on each disc roll, this would simultaneously worsen the quality of the orienting of the strands, especially with respect to the proportion of smaller strands, which would be inadequately oriented through the relatively wide orienting passages before falling onto the forming belt.

In view of the above considerations, the inventive arrangement provides that the width W of the orienting passages 9 and 10 is adjustable in order to achieve an optimal orienting of the strands in the orienting direction, for a great range of sizes of the particular wood strands that are to be supplied and processed, and also independently of the respective proportion of various different sizes of strands in the overall bulk strand material. For this purpose, the discs 8, 19 acting as the orienting elements are arranged so that they are at least partially adjustable in the axial direction in order to allow the width W of the orienting passages 9, 10 to be adjusted to the required width dimension. In the illustrated example embodiment, this is achieved by arranging the second disc roll 4 and the fourth disc roll 6 to be adjustable in the axial direction 18.

Next, beginning from the centered or initial position shown in FIG. 2, the two adjustable disc rolls 4 and 6 are each shifted or adjusted in the axial direction 18, in order to change the resulting adjusted width W of the orienting passages 8 and 19 formed between the adjustable discs 19 and the fixed-position discs 8. Thereby, each orienting passage 10 becomes larger in its width, while each orienting passage 9 on the opposite side of the respective disc 19 becomes correspondingly smaller in its width, as shown for an intermediate adjustment in FIG. 4. Thereby, it is achieved that a greater amount or proportion of larger (i.e. longer and wider) wood strands are oriented in the enlarged orienting passages 10, while the smaller wood strands can still fall down into and be properly longitudinally oriented in the smaller orienting passages 9. Thus, this arrangement achieves a higher through-flow rate because it allows the longer strands to more quickly pass through and be oriented in the enlarged orienting passages 10, while still achieving a good orienting of the smaller strands through the smaller orienting passages 9.

The two adjustable disc rolls 4 and 6 can be adjusted in the axial direction continuously or in defined steps, beginning from the initial position shown in FIG. 2, via an exemplary intermediate position shown in FIG. 4, all the way until the discs 19 nearly contact the fixed-position discs 8 of the remaining disc rolls 3, 5 and 7 in an end position with maximized passage 20 having a maximum passage width as shown in FIG. 3. Thus, in FIG. 3, the orienting passages 9 have been reduced to effectively zero width, while the orienting passages 10 have been enlarged in width to form a maximum sized orienting passage 20. With this adjustment as shown in FIG. 3, the resulting maximum width W of the passages 20 corresponds to almost the entire disc spacing on a given one of the shafts 17 (minus the thickness of the disc 19). This adjusted position is advantageously set for processing a chip or strand material having comparatively large strands, requiring a large throughput rate, and/or relatively small size variations of the strands in the supplied strand flow 16. Thus, it is possible to adjust the disc rolls accordingly to achieve the optimal orienting and spreading characteristics in each case depending on the parameters of the chip or strand material that is to be processed.

While the above described example embodiment has only two of the disc rolls 4, 6 being adjustable, it is alternatively possible to provide all of the disc rolls 3, 4, 5, 6, 7, or alternatively only one disc roll 4, to be axially adjustable. The axial adjustability can be provided either in one direction starting from the initial position, or in both opposite axial directions starting from the initial centered position. By shifting successive ones of the disc rolls in successive axial steps relative to one another, for example, an offset spreading or depositing of the oriented strands can be achieved. A two-sided or two-directional adjustability also has the advantage that the required maximum adjusting path distance of each individual disc roll 3, 4, 5, 6, 7 is reduced by half, whereby the structural complexity of the drive arrangements may be simplified or reduced, for example.

The invention also makes it possible to achieve a separated or graded spreading of wood strands dependent on size, which is especially useful in spreading chips or strands for forming multi-layered panels, for achieving an increased bending stiffness or strength of the panels. Namely, by properly adjusting the adjustable disc rolls, it is possible to spread the especially long strands included in a bulk strand material with particularly exact longitudinal orientation to form the cover layers at the outer surfaces of the finished panel, while spreading and orienting the shorter strands included in a mixed bulk strand material to form the inner or core layer of the panel. To achieve this, respective different orienting passage widths W are adjusted and set at different or successive disc rolls in the conveying direction 2. Particularly, the passage widths W in the spreading range of the first three disc rolls 3, 4, 5 are adjusted to be relatively smaller, while the last two spreading rolls 6, 7 are adjusted to provide a larger passage width W. As a result, a greater proportion of small strands flows and is oriented through the smaller orienting passages of the disc rolls 3, 4, 5 which spread material for the core of the panel, while the larger orienting passages formed by the last disc rolls 6, 7 supply and orient a greater proportion of the especially long wood strands for forming the outer surface cover layer of the panel. In this regard, for example, another spreading head was arranged upstream along the forming belt 25 to deposit the bottom cover layer and the bottom portion of the core of the panel, while the illustrated spreading head forms the upper portion of the core and the top cover layer of the panel.

The axial adjustability of the respective disc rolls 3, 4, 5, 6, 7 is preferably achieved by the axial sliding of the respective entire shaft 17 on which the discs 8, 19 are securely fixed. To achieve this, rotatable bearing rings can be provided, which include an incline, or an angled plane on their rotation path, by means of which the shaft 17 is axially slidably adjusted by partially rotating its bearing rings. Alternatively, a bearing arrangement including elongated slot holes can be provided to support the shafts 17 or their respective bearings, so that the shafts 17 can be axially slidingly adjusted along the elongated slot holes. This axial adjustment of the shafts can be carried out manually, e.g. by loosening fixing bolts and then manually sliding the respective shaft before retightening the fixing bolts, but could alternatively be carried out automatically or in a powered manner using stepper motors, servomotors, lever mechanisms, or any other conventionally known actuator arrangement, as schematically indicated at 40 in FIG. 3.

As a further alternative, the axial adjustability is carried out not by adjusting the entire shaft 17, but rather by axially shifting or sliding the discs 8, 19 on the respective shaft 17. This can be achieved, for example, by embodying the shaft 17 as a hollow pipe, with a sliding mechanism arranged internally therein, whereby the discs 8, 19 arranged externally on the shaft 17 are connected to the internal sliding mechanism to be axially slidable along the shaft 17. For example, the discs are connected to the internal sliding mechanism via elongated slot holes in the wall of the hollow pipe shaft. With this embodiment, it is further possible to adjustingly set different axial sliding displacements of the individual discs 8, 19 to achieve individual different orienting passage widths for a given single shaft 17.

As described above, the orienting passages 9, 10 are preferably formed or bounded between disc-shaped orienting elements 8, 19 that are positioned and oriented vertically and parallel relative to the conveying direction 2 of the deposited chip fleece or mat 12. Alternatively, the orienting elements could be embodied as vertically arranged longitudinally extending walls or guide walls, that are movably supported and horizontally movable by means of vibration or oscillation drives or by means of bellcrank drives, so that the supplied strand flow 16 is thereby longitudinally oriented as it passes through the vertical orienting passages 9, 10 formed between the respective guide walls, and then falls onto the forming belt 25 therebelow.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for longitudinally orienting elongated strands of a bulk material, said apparatus comprising:

a plurality of vertically extending orienting elements that form orienting passages therebetween adapted to have said elongated strands flow through said orienting passages in a longitudinally oriented manner;

a drive connected to at least some of said orienting elements to move said at least some of said orienting elements;

a conveyor arrangement that is located below said orienting passages to receive said elongated strands on said conveyor arrangement and that is adapted to convey said elongated strands in a conveying direction; and means for shifting and thereby adjusting at least a first group of said orienting elements relative to a second group of said orienting elements in an adjustment direction perpendicular to said conveying direction so as to adjust respective widths of said orienting passages in said adjustment direction.

2. The apparatus according to claim 1, wherein said orienting elements comprise discs, said apparatus further comprises a rotatable shaft on which said discs are mounted parallel to one another to form a respective disc roll, said shaft is oriented with an axis thereof parallel to said adjustment direction, said first group of said orienting elements is a first group of said discs mounted on said rotatable shaft to form a first said disc roll, and said first group of said discs are axially shiftable along said rotatable shaft or said rotatable shaft is axially shiftable together with said first group of said discs mounted thereon so as to adjust said widths of said orienting massages in said adjustment direction.

3. The apparatus according to claim 1, wherein said orienting elements comprise at least one of guide walls and discs, and wherein said drive is a rotating drive or a vertical motion drive that is coupled to at least one of said guide walls and said discs.

4. The apparatus according to claim 1, wherein said widths of said orienting passages are at most one half of an average length of said elongated strands.

5. An apparatus for longitudinally orienting elongated strands of a bulk material, said apparatus comprising:

a plurality of disc rolls that each respectively include a rotatable shaft extending axially in an axial direction, and a plurality of discs arranged on said shaft parallel to each other vertically and perpendicularly to said axial direction and spaced apart from one another along said axial direction;

a rotation drive coupled to said disc rolls to rotate said disc rolls; and a conveyor arrangement that is located below said disc rolls to receive said elongated strands on said conveyor arrangement and that is adapted to convey said elongated strands in a conveying direction perpendicular to said axial direction;

wherein said discs form vertical orienting passages respectively between adjacent ones of said discs, and said orienting passages are adapted to have said elongated strands flow through said orienting passages in a longitudinally oriented manner onto said conveyor arrangement located therebelow; and further comprising means for shifting and thereby adjusting at least a first group of said discs in said axial direction relative to a second group of said discs so as to adjust respective widths of said orienting passages in said axial direction.

6. The apparatus according to claim 5, wherein each respective one of said orienting passages is formed between two of said discs that are adjacent to each other in said axial direction and that are respectively components of two of said disc rolls that are adjacent to each other in said conveying direction, and wherein said width of said respective orienting passage is given by an adjustable spacing between said two discs in said axial direction.

7. The apparatus according to claim 6, wherein said two of said disc rolls are arranged so that said discs of one of said two disc rolls overlappingly intermesh in axial interspacings between said discs of the other of said two disc rolls.

8. The apparatus according to claim 5, wherein said discs of each one of said disc rolls are all spaced uniformly apart from one another by equal interspacing distances in said axial direction.

9. The apparatus according to claim 5, wherein said plurality of disc rolls includes at least three of said disc rolls, and wherein said first group of said discs that are adjustable are said discs of at least one of said three disc rolls.

10. The apparatus according to claim 5, wherein said first group of said discs are fixedly mounted on said shaft of an adjustable one of said disc rolls, wherein said shaft of said adjustable one of said disc rolls is axially adjustable in said axial direction relative to another one of said disc rolls.

11. The apparatus according to claim 5, wherein said first group of said discs that are adjustable are axially movably mounted on said shaft of one of said disc rolls so that said first group of said discs are movable in said axial direction along said shaft.

12. The apparatus according to claim 5, wherein an axial range of adjustability of said first group of said discs that are adjustable extends maximally to an axial interspacing distance between successive ones of said discs on a respective one of said shafts.

13. The apparatus according to claim 5, wherein said first group of said discs are manually adjustable in said axial direction.

14. The apparatus according to claim 5, wherein said means for shifting and thereby adjusting comprise an adjustment drive coupled to said first group of said discs and adapted to provide a power-driven adjustment of said first group of said discs in said axial direction.

15. The apparatus according to claim 5, further comprising a housing in which said disc rolls are arranged to form a strand spreader head, and wherein said conveyor arrangement comprises a forming belt arranged below said housing.

16. The apparatus according to claim 5, wherein said widths of said orienting passages are at most one half of an average length of said elongated strands.

17. The apparatus according to claim 5, wherein all of said discs have the same diameter.

18. The apparatus according to claim 5, wherein said first group of said discs can be adjusted to simultaneously form two different sizes of said orienting passages having different dimensions of said widths in said axial direction respectively between said discs of said first group and said discs of said second group alternately in succession in said axial direction.

19. A method of using the apparatus according to claim 1, comprising the steps:

a) feeding a bulk flow of said bulk material comprising said elongated strands onto said orienting elements;

b) driving said at least some of said orienting elements with said drive to cause a rotating or oscillating motion of said at least some of said orienting elements, and to cause said elongated strands to flow downward through said orienting passages and to thereby be oriented longitudinally in said longitudinally oriented manner;

c) depositing said elongated strands in said longitudinally oriented manner extending along said conveying direction onto said conveyor arrangement;

d) conveying said elongated strands with said conveyor arrangement; and e) before or during said steps a), b) and/or c), shifting and thereby adjusting said first group of said orienting elements in said adjustment direction relative to said second group of said orienting elements so as to adjust said widths of said orienting passages in said adjustment direction, dependent on at least one of geometric dimensions of said elongated strands, dimensional tolerances of said elongated strands, and a flow rate of said feeding of said bulk flow.

* * * * *

UNITED STATES PATENT AND TRADEMARK OFFICE

CERTIFICATE OF CORRECTION

PATENT NO. : 7,004,300 B2
APPLICATION NO. : 10/615160
DATED : February 28, 2006
INVENTOR(S) : Bossler It is certified that error appears in the above-identified patent and that said Letters Patent is hereby corrected as shown below:

Title page,
Item [56], References Cited,
U.S. PATENT DOCUMENTS,
Col. 2, Line 2, after "4,666,029 A 5/1987", replace "Burkner" by --Buerkner--;

Column 9,
Line 15, after "orienting", replace "massages" by --passages--.

Signed and Sealed this

Twenty-second Day of August, 2006

JON W. DUDAS
*Director of the United States Patent and Trademark Office*